US009199498B2

(12) United States Patent
Chen et al.

(10) Patent No.: US 9,199,498 B2
(45) Date of Patent: Dec. 1, 2015

(54) INKJET PRINTING METHOD AND APPARATUS WITH FEEDBACK CONTROL

(71) Applicants: Samuel Chen, Penfield, NY (US); Christopher Demario, Webster, NY (US); James Douglas Shifley, Spencerport, NY (US)

(72) Inventors: Samuel Chen, Penfield, NY (US); Christopher Demario, Webster, NY (US); James Douglas Shifley, Spencerport, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 7 days.

(21) Appl. No.: 14/086,145

(22) Filed: Nov. 21, 2013

(65) Prior Publication Data

US 2015/0138268 A1 May 21, 2015

(51) Int. Cl.
*B41J 29/393* (2006.01)

(52) U.S. Cl.
CPC ..... *B41J 29/393* (2013.01)

(58) Field of Classification Search
CPC ..... B41J 29/393; B41J 2/2142; B41J 2029/3935; B41J 2/125; B41J 2/0451
See application file for complete search history.

(56) References Cited

U.S. PATENT DOCUMENTS

| | | | | |
|---|---|---|---|---|
| 4,435,718 | A | | 3/1984 | Clark et al. |
| 5,581,284 | A | * | 12/1996 | Hermanson ..... 347/43 |
| 6,164,643 | A | | 12/2000 | Otsuka |
| 6,382,850 | B1 | | 5/2002 | Freund et al. |
| 6,812,997 | B2 | | 11/2004 | Kaltenbach et al. |
| 7,731,186 | B2 | | 6/2010 | Krause et al. |
| 7,742,193 | B2 | | 6/2010 | Kaltenbach et al. |
| 8,172,359 | B2 | | 5/2012 | Askeland et al. |
| 8,408,539 | B2 | | 4/2013 | Moore |
| 8,467,114 | B2 | | 6/2013 | Yakubov |
| 2010/0245448 | A1 | | 9/2010 | Kato et al. |
| 2010/0277530 | A1 | | 11/2010 | Bastani et al. |
| 2011/0203471 | A1 | | 8/2011 | Muir et al. |
| 2013/0016382 | A1 | | 1/2013 | Kitajima |
| 2013/0163827 | A1 | | 6/2013 | Rzadca et al. |

FOREIGN PATENT DOCUMENTS

WO WO 03/004280 1/2003

OTHER PUBLICATIONS

U.S. Appl. No. 13/536,150, filed Jun. 28, 2012, Chen et al.
U.S. Appl. No. 13/536,165, filed Jun. 28, 2012, Chen et al.

* cited by examiner

*Primary Examiner* — Lamson Nguyen
(74) *Attorney, Agent, or Firm* — David A. Novais; William R. Zimmerli

(57) ABSTRACT

An inkjet printing method and system includes an arrangement that is adapted to repair a printed image using a combination of in-line imaging and feedback control of an inkjet printhead or printing with a redundant inkjet printhead. The inkjet printing method and system is further adapted to print at higher optical density than is normally possible by use of multi-pass capabilities.

22 Claims, 6 Drawing Sheets

INKJET PRINTING METHOD AND APPARATUS WITH FEEDBACK CONTROL

CROSS REFERENCE TO RELATED APPLICATIONS

This application relates to commonly assigned, copending U.S. application Ser. No. 14/1086,163, filed Nov. 21, 2013 entitled: "INKJET PRINTING METHOD AND APPARATUS USING A REDUNDANT PRINTHEAD"; U.S. application Ser. No. 14/086,191, filed Nov. 21, 2013 entitled: "HIGH OPTICAL DENSITY INKJET PRINTING METHOD", each of which is hereby incorporated by reference.

FIELD OF THE INVENTION

The present invention relates to an inkjet printing method and system, and more particularly an inkjet printing method and system that is adapted to repair a printed image.

BACKGROUND OF THE INVENTION

Inkjet printing is commonly used for printing on paper or other types of print media and is generally a non-contact application of an ink to the print media. Typically, one of two types of ink jetting mechanisms are used and are categorized by technology as either drop on demand ink jet (DOD) or continuous ink jet (CIJ). The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

Additionally, there are typically two types of print media used with inkjet printing systems. The first type is commonly referred to as a continuous web while the second type is commonly referred to as a cut sheet(s). The continuous web of print media refers to a continuous strip of media, generally originating from a source roll. The continuous web of print media is moved relative to the inkjet printing system components via a web transport system, which typically include drive rollers, web guide rollers, and web tension sensors. Cut sheets refer to individual sheets of print media that are moved relative to the inkjet printing system components via rollers and drive wheels or via a conveyor belt system that is routed through the inkjet printing system.

In inkjet printing systems that utilized inkjet printheads having nozzles, there is a problem in that if a nozzle becomes defective, that defect will show up on a printed image in the form of a streak which adversely effects that output of the inkjet printing system.

SUMMARY OF THE INVENTION

The present invention relates to the concept of repairing a printed image using a combination of in-line imaging and feedback control of an inkjet printhead.

The present invention relates to a method of printing which comprises transporting media in an initial print pass to an inkjet printhead; using the inkjet printhead to print an image on the media by applying ink from nozzles on the inkjet printhead onto the media; inspecting the printed image on the media to detect a presence of at least a continuous streak in the printed image caused by at least one defective nozzle in the inkjet printhead; transporting the media with the printed image thereon in an additional print pass back to inkjet printhead if a streak is detected on the printed image; adjusting a cross track position of one of the media or the inkjet printhead relative to the other of the media or the inkjet printhead to position a non-defective nozzle of the inkjet printhead over the detected streak; and applying ink from the non-defective nozzle to an area of the printed image corresponding to the detected streak to repair the streak in the printed image.

The present invention further relates to a printing apparatus which comprises an inkjet printhead adapted to print an image on media by applying ink from nozzles on the inkjet printhead onto the media; an image capture device adapted to inspect the printed image on the media to detect a presence of at least a streak in the printed image caused by at least one defective nozzle in the inkjet printhead; and an adjustment device adapted to adjust a cross track position of one of the media or the inkjet printhead relative to the other of the media or the inkjet printhead if a streak is detected on the printed image by the image capture device to position a non-defective nozzle of the inkjet printhead over the detected streak, so that ink from the non-defective nozzle can be applied to an area of the printed image corresponding to the detected streak to repair the detected streak in the printed image.

DETAILED DESCRIPTION OF THE INVENTION

Figure 1:
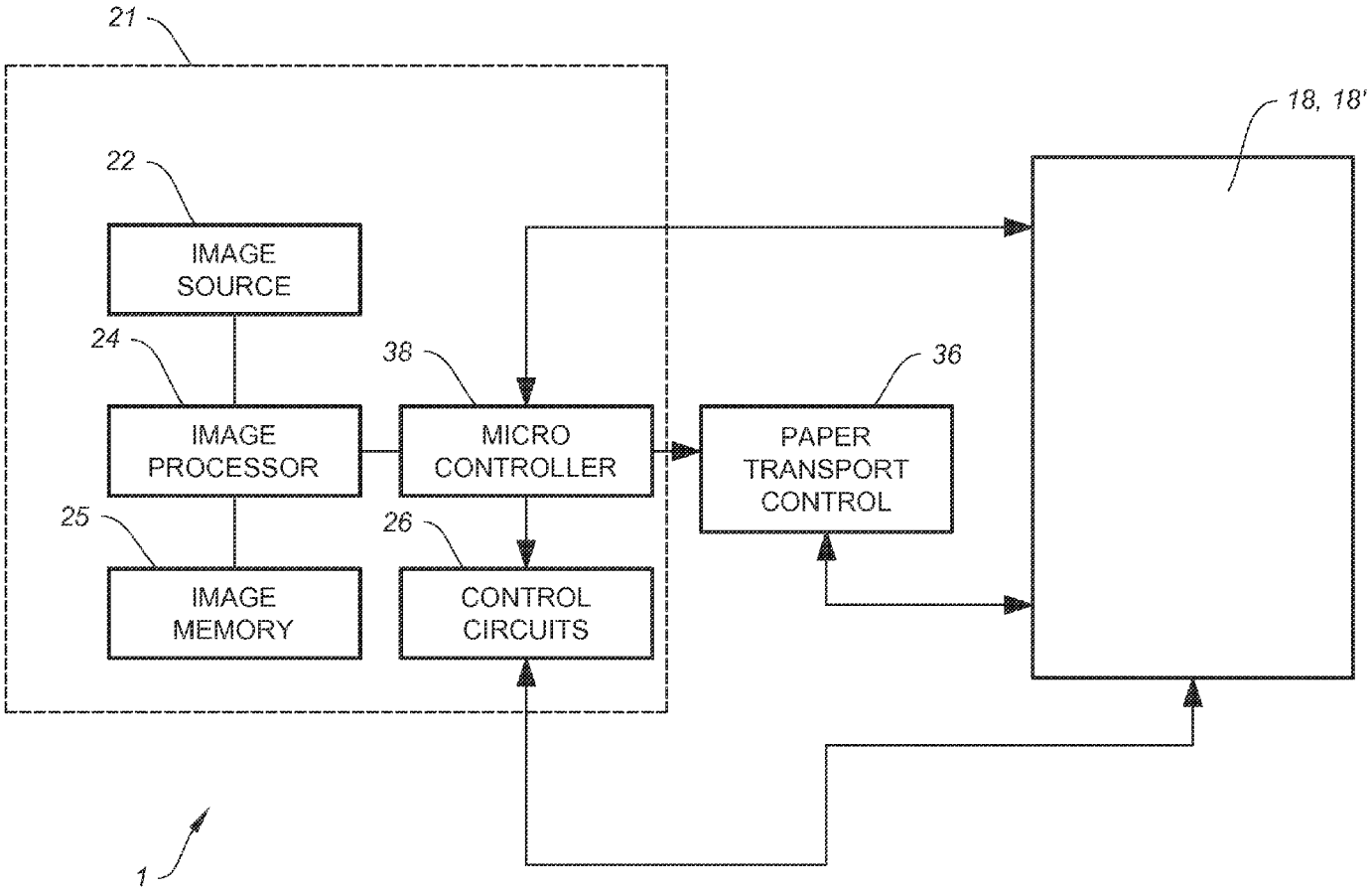
FIG. 1 illustrates an inkjet printing system in accordance with a first feature of the present invention including a control system for the inkjet printing system.
Figure 3:
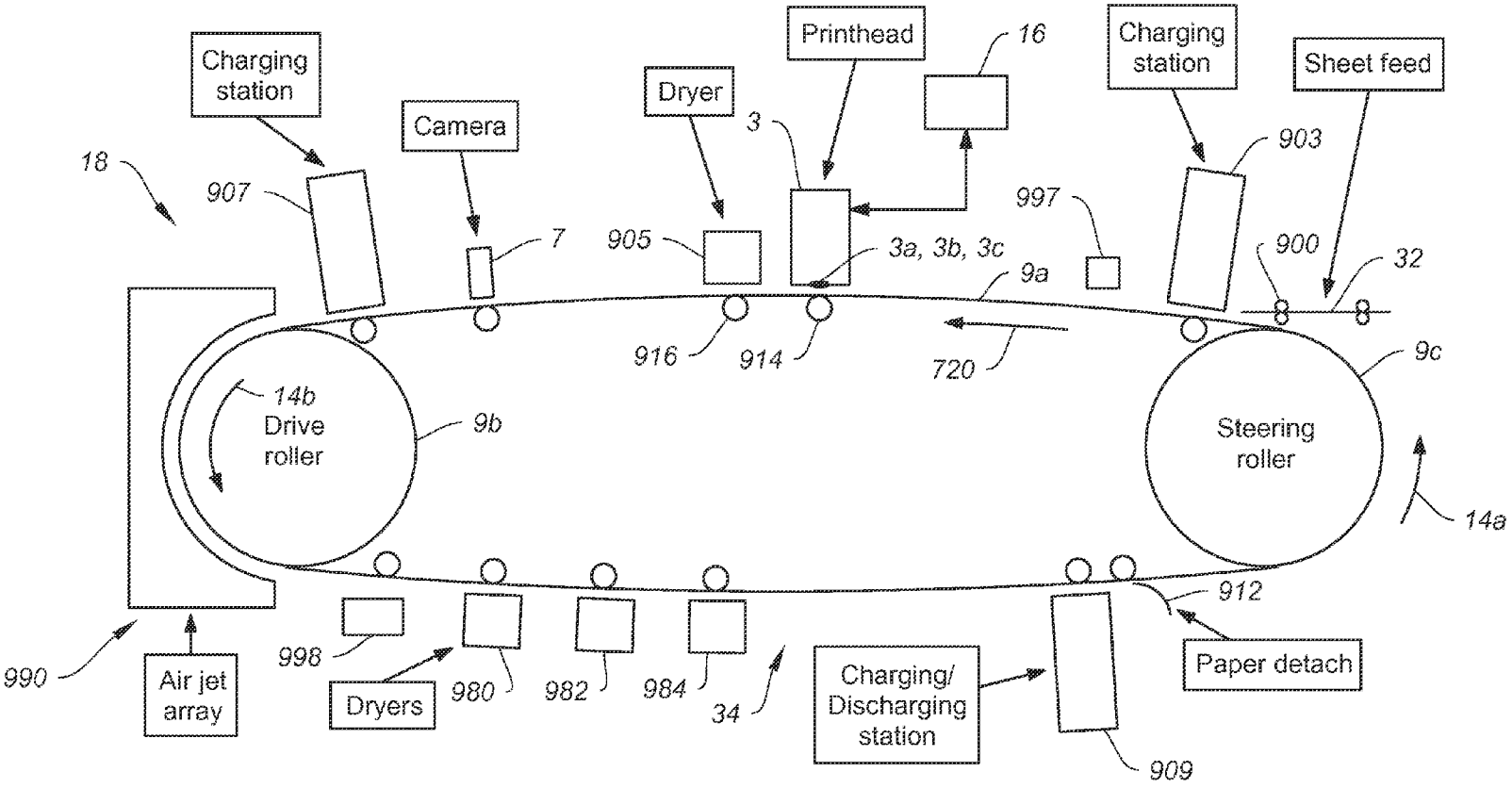
FIG. 3 illustrates features of an imaging and conveying section of an embodiment of an inkjet printing system of the present invention.
Figure 4:
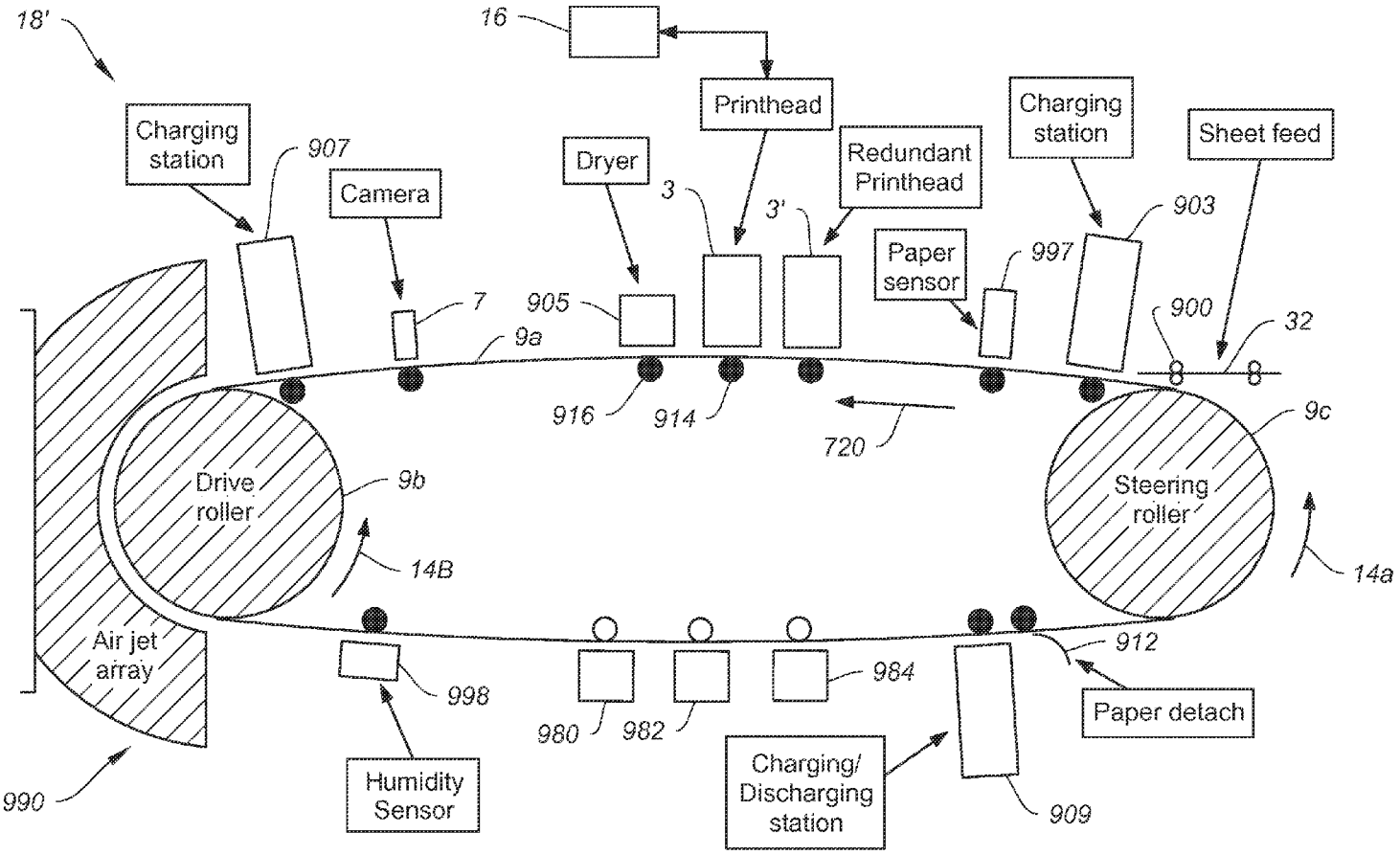
FIG. 4 illustrates features of an imaging and conveying section of a further embodiment of an inkjet printing system of the present invention.

Referring now to the drawings, wherein like reference numerals represent similar or identical parts throughout the several views, FIG. 1 illustrates a printing apparatus or system 1 in accordance with a feature of the present invention. As shown in FIG. 1, printing apparatus 1 includes an imaging and conveying section 18 wherein elements of the imaging and conveying section are shown in FIGS. 3 and 4. In a first embodiment, printing apparatus 1 and particularly imaging conveying section 18 as shown in FIG. 3, includes an inkjet printhead 3 adapted to print an image on print media 32 by applying ink from nozzles 3*a*, 3*b*, 3*c* on inkjet printhead 3 onto print media 32 to provide for a printed image on the print media 32. The nozzles can be positioned in a known manner in an array and have exits that face the media, and particularly can be positioned in a spaced manner which at least includes a row of nozzles that extend in a cross track direction.

Referring back to FIG. 1, printing apparatus 1 includes a control system 21 with an image source 22, an image processor 24, an image memory 25, control circuits 26 and a microcontroller 38. Image data is received from image source 22, e.g., a scanner, computer or communication module. Image source 22 can be integral to printing apparatus 1 or otherwise. The image data can take the form of raster image data, outline image data in the form of a page description language, or any other form of digital data that can be used to form a digital image that can be printed. This raster image data is converted to bitmap image data by image processor 24 and is optionally stored in image memory 25.

Printing apparatus 1 forms an inkjet image by transferring drops of ink from inkjet printhead 3 (FIG. 3) that carry an image forming material, such as a colorant, in a liquid such as a solvent or dispersant that either dissolves or disperses the image forming material.

The ink is patterned and delivered in the form of drops using inkjet printhead 3. Inkjet printhead 3 has a plurality of control circuits (not shown) that apply time-varying electrical pulses to one or more drop forming device(s) (not shown) each associated with one or more nozzles of printhead 3. These pulses are applied at an appropriate time, and to the appropriate nozzle, so that drops formed will be applied to recording medium 32 at positions designated by the data in the image memory 25.

Recording medium 32 is moved relative to printhead 3 by a recording medium conveying device or transport system 34 shown in FIG. 3, which is electronically controlled by a paper transport control or recording medium conveying device control 36, which in the embodiment of FIG. 1 is controlled by microcontroller 38 of control system 21.

As shown in FIG. 3, conveying device 34 takes the form of an endless belt 9*a*. Microcontroller 38 of FIG. 1 controls the timing of control circuits 26 and recording medium conveying 34 so that drops of inkjet ink lands at the desired locations on recording medium 32. Microcontroller 38 can be implemented using a central processing unit, a programmable logic device, programmable logic array, programmable array logic, a field programmable array, programmable logic device, a microcontroller, or any other digital stored-program or stored-logic control element or a hardwired controller.

As indicated above, conveying device 34 or media transport uses endless belt 9*a*. In a feature of the invention, endless belt 9*a* is flexible, insulating and usually polymeric in composition. The belt 9*a* is partially wrapped around rotating rollers 9*b*, 9*c* that guide the endless belt so that the belt can loop around continuously, and includes at least one drive roller 9*b* driven by for example, a motor and/or other drive means and one steering roller 9*c*. The belt 9*a* can be made of polyester or polyimide type of material, and because it is an insulator, it can be charged up locally to hold individual pieces of print media by electrostatic adhesion. As shown in FIG. 3, a sheet of print media 32, typically an insulator, can be conveyed toward belt 9*a* by a sheet feeder 900. Prior to touching the belt 9*a*, the print media 32 is made to first pass through an electrostatic charging station having a charger 903 so that the media 32 becomes charged up. Normally this charger 903 provides negative charge, so that the print media surface becomes overall negatively charged. As the print media 32 approaches the belt 9*a*, the surface of the belt 9*a* becomes inductively charged positively, with the result that the print media 32 is electrostatically held in place. Since both the print media 32 and the belt 9*a* are insulating, their charges will remain stationary as the print media 32 is moved in a continuous loop. All components that the belt comes in contact with need to be electrostatically insulating so as to avoid any deliberate charge dissipation. Otherwise the print media will fall off once it is rotated into an upside down configuration.

Figure 5:
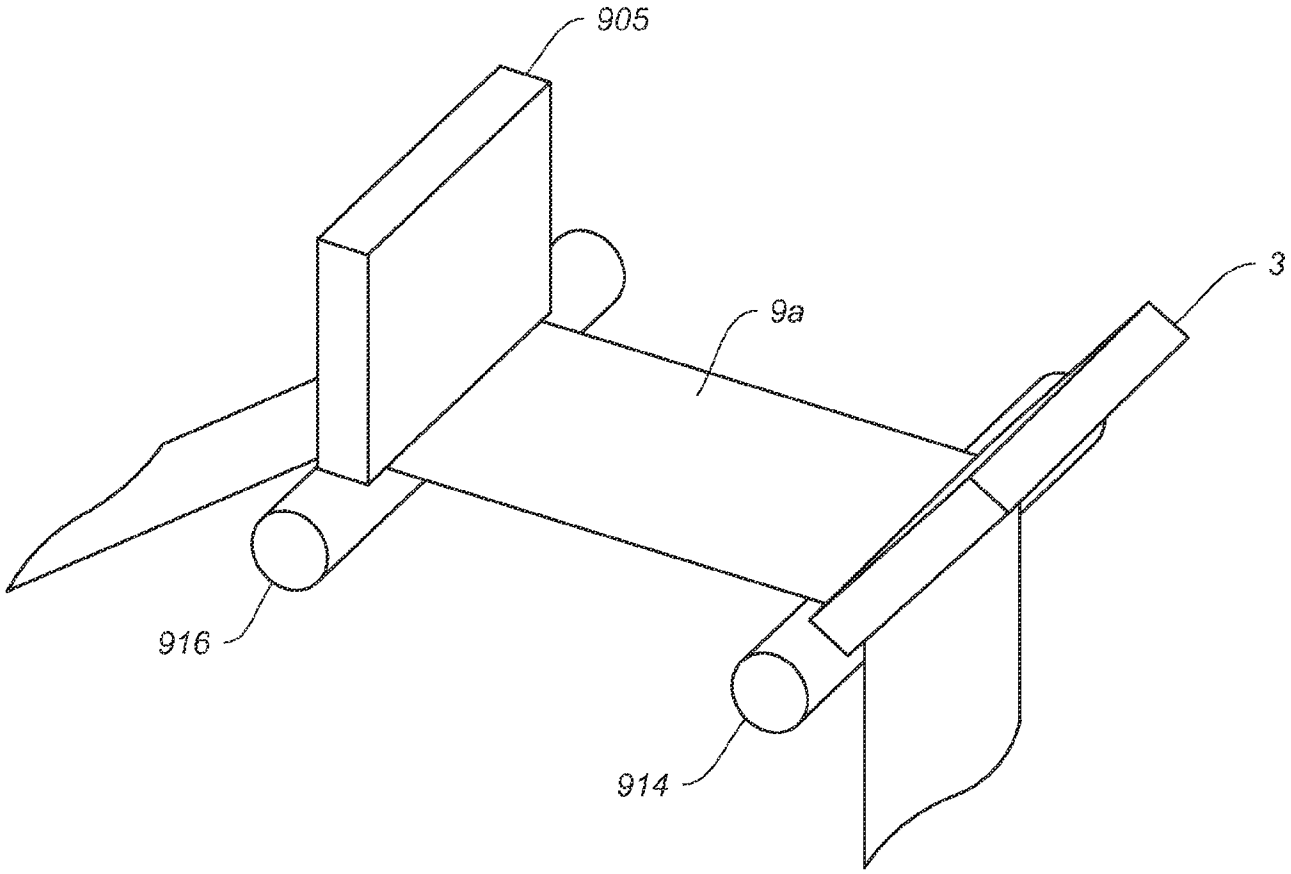
FIG. 5 illustrates a portion of the imaging and conveying section of the inkjet printing system of the present invention.

Along various parts of the loop pathway defined by the endless belt 9*a* are modules and sensors that can interact with the print media surface. Various modules along the loop pathway may include a printing station where inkjet printhead 3 is located, a drying or fixing station having a dryer 905, a scanning or image capture device or station which can be a camera 7, an additional electrostatic charging station having a charger 907, an electrostatic charging and/or discharging station having a charger or discharger 909 and a print media detachment station 912. Generally, these stations and particularly the elements or modules of these stations are located over a roller, so that the print media is kept uniformly flat in the cross-track direction as shown in FIG. 5. FIG. 5 is an example which shows a portion of the media path illustrated in FIG. 3 and particularly inkjet printhead 3 opposite roller 914, and dryer 905 opposite roller 916. As shown in FIG. 5 this arrangement assures that the media will lie flat as it is transported past elements such as the inkjet printhead 3 and the dryer 905. Other modules or elements that can be included along the print path are devices for cutting, folding, binding or glossing the media. Various sensors along the loop pathway may include those that detect various properties of the media along the print path. For example, these sensors can detect the leading and trailing ends of the media, or the humidity level on the surface of the media.

Within the context of the present invention, the inkjet printhead 3 can be adapted to eject drops of ink for printing. The inks may be aqueous, solvent or oil based inks, UV or electron beam curable inks or phase change inks. The drying or fixing station can include devices such as dryers that accelerate the drying of the media surface by methods based on the application of heat to the ink through radiative, convective or conduction means, or the enhancement of vapor removal through air flow means including turbulent air flow, through reduced atmospheric pressure, and/or through ultrasonics. The scanning or image capture station can include a linear array or area array camera 7 as noted above which is capable of capturing an image of at least a portion of printed content on the media surface, and the images can be captured continuously or on an as-needed basis.

When the print media 32 needs to be removed, the print media 32 can pass by a discharging and/or charging unit or station which can include a discharger/charger 909 (utilized here as a discharger) located upstream of the media removal station or paper detach station 912, which is selectively activated to reduce or neutralize the electrostatic charge on the print media surface, so that the electrostatic force between the print media 32 and the belt 9*a* is reduced. In some embodiments, if the media is to be retained on the transport belt for a subsequent printing pass, the charging/discharging unit 909 is selectively activated to increase the electrostatic charge on the print media surface to ensure that the print media does not detach from the transport belt as the print media is going around the steering roller 9*c*. In such embodiments, the charging/discharging unit 909 is a bipolar charging unit able to either selectively apply a charge of one polarity to increase the electrostatic forces holding the print media 32 to the belt 9*a*, or to selectively apply a charge of the opposite polarity to decrease the electrostatic forces holding the print media 32 to the belt 9*a*. To further assist the print media detachment process, an air knife (a high pressure jet of air) aimed at the gap between the print media and the belt can be energized, so that the leading edge of the print media becomes separated from the belt surface and the released media can then be directed toward a media collection tray. Other methods of removing the print media 32 may include a mechanical blade that can go between the leading edge of the print media 32 and the belt 9*a* and cause the print media 32 to separate. Print media removal is only used on an as-needed basis, so that the print media 32 can stay on the belt 9*a* for as many cycles as is needed to finish all the printing requirements.

Figure 6:
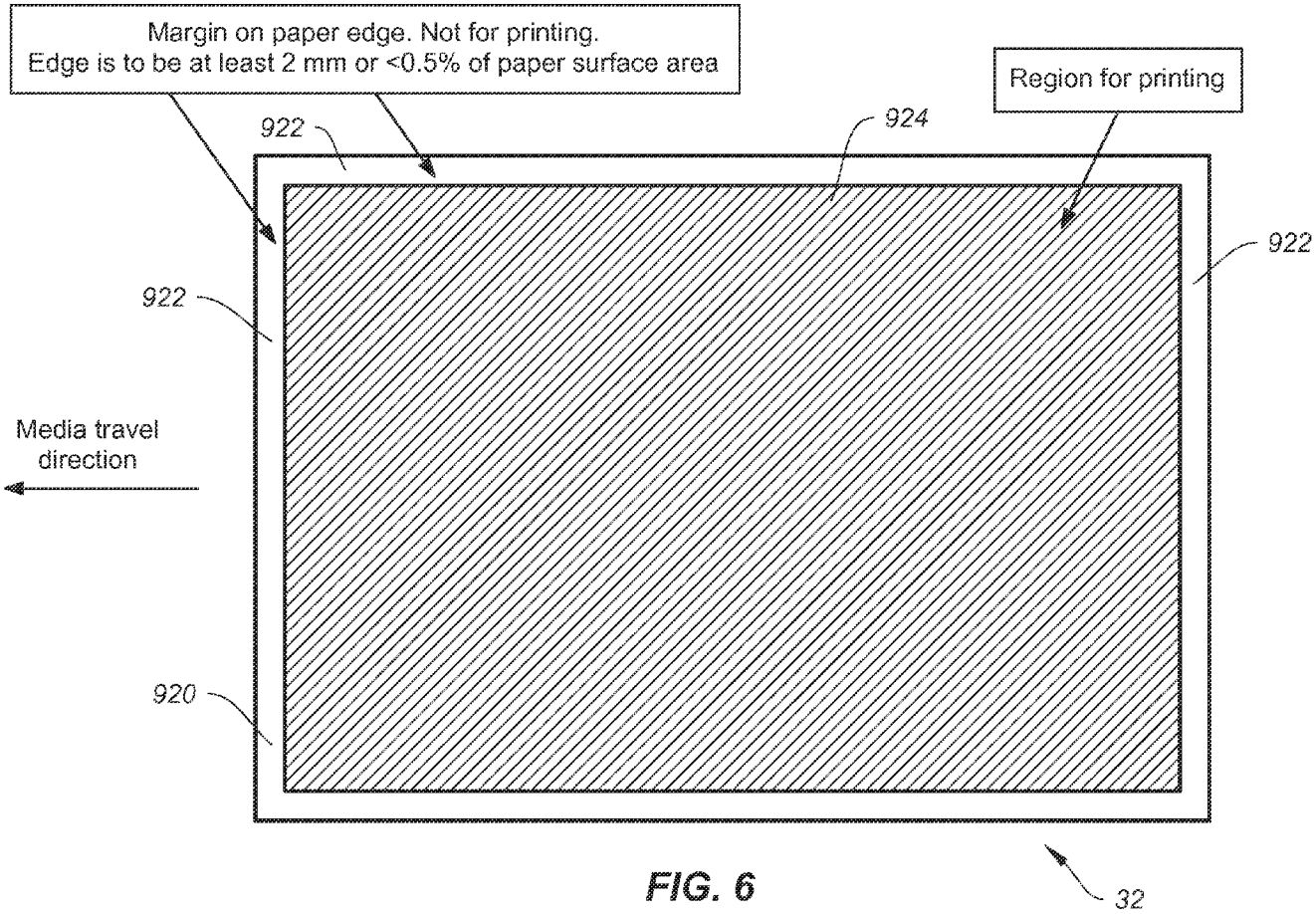
FIG. 6 illustrates an example relative to media to be used with the inkjet printing system of the present invention.

Generally, electrostatic adhesion of print media on insulated polymeric belts is avoided in applications where the print media (or belt) is subject to a high level of humidity. Such a condition usually renders the electrostatic charging process difficult to control because water vapor on insulating surfaces can non-uniformly dissipate static charge, and this can render print media adhesion non-uniform, to the degree that it can occasionally fall off the belt when it is in an upside down configuration. However, under certain conditions this configuration can work. In a feature of the present invention as shown in FIG. 6, once the print media is electrostatically adhered onto the belt, placement of aqueous-based inks drops must be carefully controlled. Ink placement needs to avoid a leading edge 920 of the moving print media 32, and the deposited ink needs to be dried sufficiently so as to prevent its diffusion all the way to the lower surface of the media 32. So long as the boundary 922 of the print media 32 (including the edges and the bottom) is not allowed to accumulate significant quantities of water, the print media edge will consistently hold onto the belt 9*a* regardless of whether the print media is upside down or not. FIG. 6 illustrates a preferred region for printing 924 surrounded by boundary 922. In a preferred embodiment, this boundary should be at least 1-2 mm or no less than 1.5% of the paper surface area for an A4 size media. Also, the electrostatic forces for securing the media to the endless belt are preferably higher at a lead edge of the media than in other portions of the media. In a feature of the invention, it is noted that the edges (or margins) of the media 32 should not be printed on (with edges of 1 mm at the minimum, but can be larger).

The use of a polymeric and insulating belt to transport print media for high speed inkjet printing application provides for a low cost conveying method. Also, the electrostatic belt 9*a* provides for a simpler and more responsive control of the detachment of the paper than would be possible in a vacuum hold down approach. This is due to the fact that it is easier to selectively discharge a portion of a belt to enable release of a sheet than it is to selectively cut the vacuum under a sheet to release the sheet due to the lag time that would be involved when the vacuum is shut off.

Figure 2:
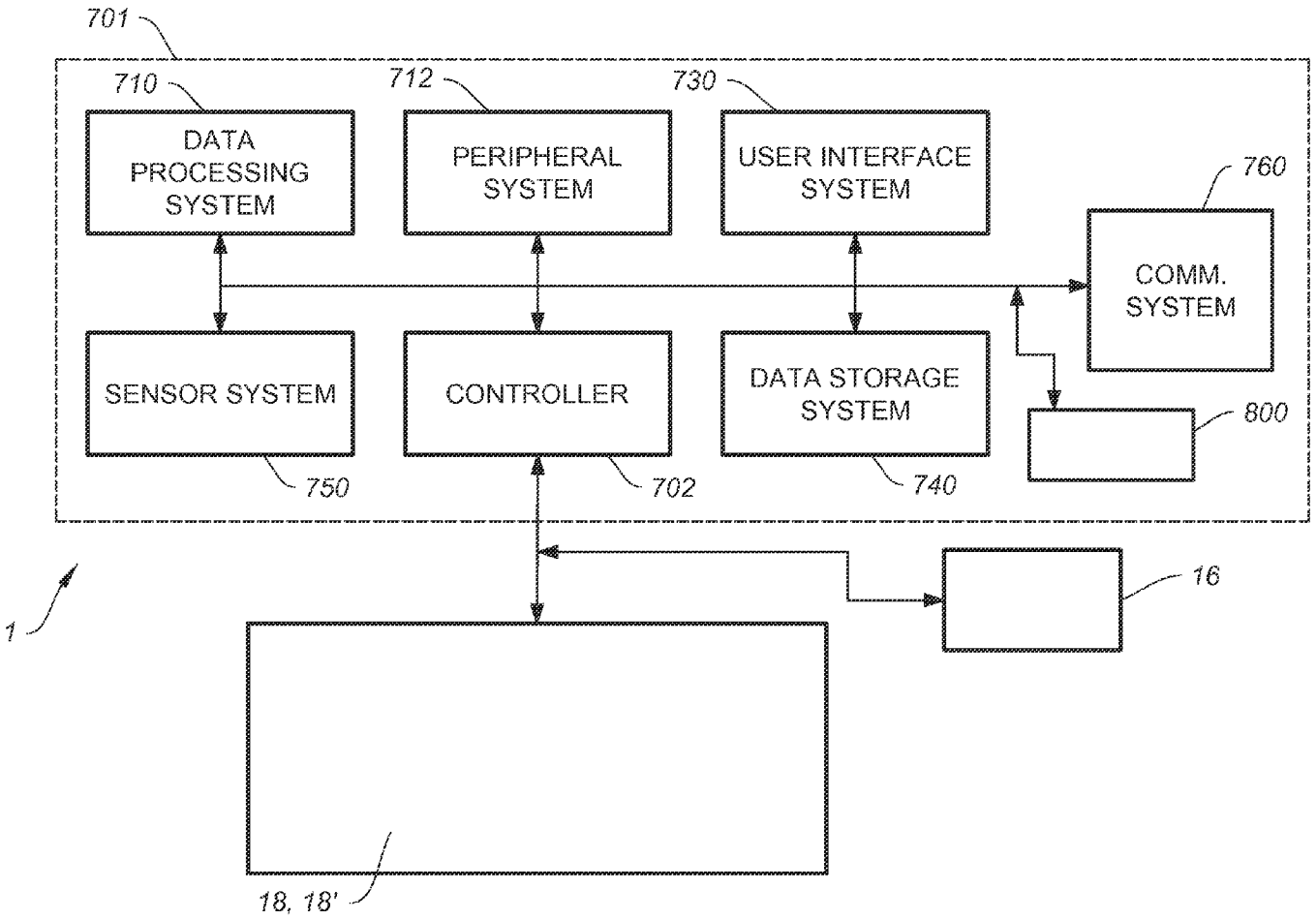
FIG. 2 illustrates a system level view of an embodiment of the inkjet printing system of the present invention including a control system.

FIG. 2 shows a system level view of an embodiment of printing apparatus 1. As is shown in FIG. 2, printing apparatus 1 can include a control system 701 that controls and integrates operation of the elements and modules of imaging and conveying section 18, 18' the particulars of which are respectively illustrated in FIGS. 3 and 4.

In operation, control system 701 causes an actuator or motor in conveying device 34 (shown in FIG. 3) to move endless belt 9 so as to advance the recording medium 32 in a printing direction 720 (FIG. 3) past inkjet printhead 3.

Control system 701 has a controller 702 that communicates with a data processing system 710, a peripheral system 712, a user interface system 730, a data storage system 740, a sensor system 750, a communication system 760 and a compensational controller 800. Peripheral system 712, user interface system 730 and data storage system 740 are communicatively connected to data processing system 710.

Data processing system 710 includes one or more data processing devices that implement the processes of various embodiments, including the example processes described herein. The phrases "data processing device" or "data processor" are intended to include any data processing device, such as a central processing unit ("CPU"), a desktop computer, a laptop computer, a mainframe computer, a personal digital assistant, a Blackberry™, a digital camera, cellular phone, or any other device for processing data, managing data, or handling data, whether implemented with electrical, magnetic, optical, biological components, or otherwise.

Peripheral system 712 can include one or more devices configured to provide digital content records to controller 702 and to data processing system 710. For example, peripheral system 712 can include digital still cameras, digital video cameras, cellular phones, or other data processors. Data processing system 710, upon receipt of digital content records from a device in peripheral system 712, can store such digital content records in data storage system 740. Peripheral system 712 can also include a printer interface for causing a printer to produce output corresponding to digital content records stored in data storage system 740 or produced by data processing system 710.

User interface system 730 can include a mouse, a keyboard, another computer, or any device or combination of devices from which data is input to data processing system 710. In this regard, although peripheral system 712 is shown separately from user interface system 730, peripheral system 712 can be included as part of user interface system 730.

User interface system 730 also can include a display device, a processor-accessible memory, or any device or combination of devices to which data is output by data processing system 710. In this regard, if user interface system 730 includes a processor-accessible memory, such memory can be part of data storage system 740 even though user interface system 730 and data storage system 740 are shown separately in FIG. 2.

Data storage system 740 includes one or more processor-accessible memories configured to store information, including the information needed to execute the processes of the various embodiments, including the example processes described herein.

Data storage system 740 can be a distributed processor-accessible memory system including multiple processor-accessible memories communicatively connected to data processing system 710 via a plurality of computers or devices. On the other hand, data storage system 740 need not be a distributed processor-accessible memory system and, consequently, can include one or more processor-accessible memories located within a single data processor or device. The phrase "processor-accessible memory" is intended to include any processor-accessible data storage device, whether volatile or nonvolatile, electronic, magnetic, optical, or otherwise, including but not limited to, registers, floppy disks, hard disks, Compact Discs, DVDs, flash memories, solid state or semi-conductor Read Only Memory (ROM), and solid state or semi-conductor Random Access Memory.

The phrase "communicatively connected" is intended to include any type of connection, whether wired or wireless, between devices, data processors, or programs in which data can be communicated. The phrase "communicatively connected" is intended to include a connection between devices or programs within a single data processor, a connection between devices or programs located in different data processors, and a connection between devices not located in data processors at all. In this regard, although the data storage system 740 is shown separately from data processing system 710, one skilled in the art will appreciate that data storage system 740 can be stored completely or partially within data processing system 710. Further in this regard, although peripheral system 712 and user interface system 730 are shown separately from data processing system 710, one skilled in the art will appreciate that one or both of such systems can be stored completely or partially within data processing system 710.

Data processing system 710 is used to receive signals that define what image is to be printed and on what receiver the image is to be printed. Further, data processing system 710 is used to help convert image information into image information. In particular, data processing system 710 can include a dedicated image processor or raster image processor (RIP; not shown), which can include a color-separation screen generator or generators or a general purpose processor that is adapted to perform raster image processing and other processing described herein.

In a situation where inkjet printhead 3 develops an error, such as a nozzle 3*a*, 3*b*, 3*c* fails and does not eject ink, the printed image will contain a white streak since that location will have no ink laydown across the entire page. Such printed media would normally be considered a wasted page. In a feature of the present invention as shown in FIG. 3, in-line image capture device or camera 7 can be located downstream of the inkjet printhead 3 with respect to the direction of travel 720 of the recording or print media or medium 32. Image capture device 7 is adapted to inspect the printed image on the print media 32 to detect the presence of a defect in the printed image and more particularly the presence of at least a streak in the printed image caused by at least one defective nozzle 3*a*, 3*b*, 3*c* in the inkjet printhead 3. As described above, image capture device 7 could be a scanner or a two dimensional linear array camera that is adapted to capture the printed image in order to detect the defect. By having an in-line image capture device 7, it is possible to continually monitor each printed media/page and then image process the scanned image to determine the occurrence of the white streak. The image capture device 7 can be adapted to scan the full width of the print media 32, including the print media side edges. The streaks can be detected by a variety of ways, based on well known image processing methods.

Streaks in inkjet printed media can come from two sources: a white or missing jet region and a dark or excess ink laydown artifact. For the former, a missing jet can occur when ink cannot be jetted out of a nozzle (for various reasons), and ink is not laid down on the transported media. Such a situation results in a streak that is devoid of ink and it would appear white on a white page. For the other situation, an artifact may exist (for various reasons) between two near neighboring nozzles in a printhead, such that the jetted ink from one merges with that of the other (e.g. caused by a crooked jet situation). Such a scenario would result in ink laydown in this region where the printed region is significantly darker than intended.

For either case, the presence of a white or dark streak can be detected by an in-line camera using a number of image processing algorithms. One possibility is to set the camera to open its shutter for a relatively long period of time so that the printed content can be optically averaged along the media transport direction. Any region with a white or dark streak can then be detected using derivatives (see, for example, U.S. Ser. No. 13/536,150, filed Jun. 28, 2012 and U.S. Ser. No. 13/536,165, filed Jun. 28, 2012 which identify a linehead producing an artifact in content printed on a moving print media). These algorithms can also detect media edges and these results can then be used to calculate the location of the defective nozzle(s) that caused the white or dark streaks.

As also shown in FIG. 3, the printing apparatus 1 further includes conveying device 34 in the form of endless belt 9*a* having an electrostatic transport web surface that is adapted to electrostatically hold print media 32 and transport media 32 from an input to the apparatus, past inkjet printhead 3 and past image capture device 7. The printed media 32 (in cutsheet form) that is transported on the electrostatic transport web surface of belt 9*a* can be made to remain on the belt surface through multiple rotations, until it is released using known external mechanical or electrostatic means.

In a further feature of the present invention, once the streak is detected by image capture device 7, a feedback signal can be triggered and sent to a compensational controller 800 (shown in FIG. 2) for printing apparatus 1 to set the system in a compensational mode. In the case of a dark streak, the compensational mode can include diverting the printed media with the dark stream to a waste bin, not shown. With the defective nozzle that made the dark defect deactivated, the document is reprinted. By deactivating the defective nozzle, the dark streak is now replaced during a first printing pass with a white defect. With a white streak present after printing a first pass of the document, the compensational mode can include operating the conveying device 34 in a manner in which the electrostatic transport web surface of belt 9*a* continues to electrostatically hold print media 32 having the detected streak thereon, and conveys print media 32 along a cyclical path 14*a*, 14*b* so that print media 32 with the detected streak thereon is returned to a position upstream of inkjet printhead 3 with respect to direction of travel 720.

The printing apparatus 1 and/or inkjet printhead 3 of the present invention can include an adjustment device 16 schematically illustrated in FIGS. 2, 3 and 4 that is adapted to adjust a cross track position of one of media 32 or inkjet printhead 3 relative to the other of media 32 or inkjet printhead 3. In a preferred embodiment, the cross track position of the inkjet printhead 3 relative to the media 32 is adjusted, however, the present invention is not limited thereto and it is recognized that the cross track position of the media 32 with respect to the inkjet printhead 3 can also be adjusted. This adjustment is effective to position a non-defective nozzle 3*a*, 3*b*, 3*c* of inkjet printhead 3 over the detected streak. In this position, ink from non-defective nozzle 3*a*, 3*b*, 3*c* can be applied to an area of the printed image corresponding to the detected streak to repair the detected streak in the printed image. Adjustment device 16 can be an electro-mechanically controlled motor to drive arrangements such as gears, pneumatics, optical encoders etc., that are operationally associated with inkjet print 3 to controllably move inkjet printhead 3. Examples of adjustment devices that can be utilized within the context of the present invention are illustrated in U.S. Pat. Nos. 4,435,718 and 6,164,643, which respectively show electro-mechanical control and actuation arrangements for adjusting the position of a printhead or media.

The inkjet printhead 3 or media 32 can move in a cross-track direction with the aid of a motor, (also see, for example, US 2011/0203471 which shows a flexure mount to support a printhead to all small lateral position adjustments). For example, in the event that inkjet printhead 3 is being moved, inkjet printhead 3 can move a small distance in the cross-track direction so that ink can be laid down over the region where nozzles 3*a*, 3*b*, 3*c* have failed by using nozzles 3*a*, 3*b*, 3*c* that are still working well. This would require that inkjet printhead 3 moves only a short distance, back and forth, to accommodate the number of nozzles that are out. This would result in a decrease or reduction in printing waste.

In a method of printing in accordance with a feature of the present invention, print media 32 inserted into printing apparatus 1, would be conveyed or transported by conveying device 34 while being electrostatically held in an initial print pass to inkjet printhead 3 of printing apparatus 1. Inkjet printhead 3 is activated to print an image on print media 32 by applying ink from nozzles 3*a*, 3*b* and 3*c* on inkjet printhead 3 onto media 32. The printed image on media 32 is then inspected (for example, captured or scanned using camera 7 or a scanner) to detect a presence of at least a streak in the printed image caused by at least one defective nozzle 3*a*, 3*b*, 3*c* in the inkjet printhead 3. If a streak is detected as a result of this inspection, a feedback control signal is triggered and sent to compensational controller 800. This causes media 32 with the printed image thereon to be transported in a cyclical manner while being held on conveying device 34 in an additional print pass back to inkjet printhead 3. This can be considered a compensational mode of the printing apparatus 1. In the compensational mode of the present embodiment, media 32 is transported through the imaging and conveying section 18 in the same direction 720 during both the initial print pass and the additional print pass. In some inkjet printing systems, the printheads can create minor artifacts such as satellite drops trailing a printed character. The conveying of the media past the printheads of the imaging section in the same direction in both the initial print pass and the additional print pass can improve the consistency of the print over that of a bi-directional print by ensuring that that the minor artifacts are placed consistently relative to the characters.

In this compensational mode, a cross track position of one of media 32 or inkjet printhead 3 (preferably inkjet printhead 3) relative to the other of media 32 or inkjet printhead 3 is adjusted by adjustment device 16 to position a non-defective nozzle 3*a*, 3*b*, 3*c* of inkjet printhead 3 over the detected streak on the printed image of media 32 which has been returned back to inkjet printhead 3. This permits ink to be applied from a non-defective nozzle 3*a*, 3*b*, 3*c* to an area of the printed image corresponding to the detected streak to repair the streak in the printed image. In a further feature of the invention, once a defective nozzle is identified and a shifting of the inkjet printhead is called for, within the context of the invention, a user may coordinate several initial print passes in a row followed by a set of additional print passes so that the printhead isn't being shifted back and forth for each print media passing the printhead.

If as a result of the inspection of print media 32 with the image thereon no streak is detected, media 32 is not transported back to the printhead 3 and through imaging and conveying section 18 for the additional print pass, and the media can instead be ejected from the printing apparatus through paper detach 912.

In a further feature of the invention, the crosstrack location of the streak can be precisely found by further processing the images captured by the capture device 7 through controller 800 if a streak is detected. The results of this further processing including the crosstrack location of the streak can be provided to adjustment device 16 to enable a more precise adjustment of the cross track position of media 32 or inkjet printhead 3 relative to each other in accordance with the determined location of the detected streak.

With the apparatus and system of the present invention, once it is determined that a defective nozzle exists in inkjet printhead 3, the location of the defective nozzle can be stored in memory and preemptive corrections can be made for the printing of subsequent documents. In the case of dark defects, the defective jet can be deactivated so that rather than print a dark defect, the first pass print has a white defect. A second print pass can then be used to fill in the white defect as has been described above. In another embodiment, the preemptive corrections can include the adjusting of the cross-track position of media 32 or inkjet printhead 3 for subsequent media so as to align the defective nozzle with a non-print region of the image.

A second compensation system and method in accordance with the present invention can include the use of a second, redundant inkjet printhead 3' illustrated in FIG. 4, located upstream from first inkjet printhead 3 and image capture device 7 with respect to direction of travel 720 of the print media 32. Although FIG. 4 illustrates redundant inkjet printhead 3' upstream of inkjet printhead 3, it is recognized that redundant printhead 3' can optionally be located downstream from inkjet printhead 3, with respect to direction of travel 720, while being located upstream from image capture device 7. A printing apparatus and more particularly an imaging and conveying section 18' in accordance with this second system and method is shown in FIG. 4. In this embodiment, the imaging and conveying section 18' as illustrated in FIG. 4 includes first inkjet printhead 3 similar to inkjet printhead 3 described with reference to FIG. 3 which is adapted to print an image on media 32; image capture device 7 adapted to inspect the printed image on media 32 to detect a presence of at least a streak in the printed image caused by a defect in first inkjet printhead 3; and a second redundant inkjet printhead 3' adapted to apply ink onto at least an area of the printed image corresponding to the detected streak to repair the streak in the printed image. An example of a method of detecting or identifying a streak in media is illustrated in US Patent Publication No. 2013/016382.

In the embodiment of FIG. 4, second inkjet printhead 3' would only lay ink down on the white streak area, such that the content can be repaired. The use of a negative print mask is one way to print this second image. More particularly, in a method of printing with a printing apparatus having imaging and conveying section 18' as shown in FIG. 4, media 32 is transported using conveying device 34 to first inkjet printhead 3 (redundant inkjet printhead 3 is not activated at this point). Thereafter, first inkjet printhead 3 is used to print an image on media 32. Media 32 with the printed image thereon is then conveyed to image capture device 7 or alternatively image capture device 7 is located over media 32 with the printed image thereon, to inspect the printed image on media 32 to detect a presence of at least a streak in the printed image caused by a defect in first inkjet printhead 3. If a white streak is detected, and the redundant inkjet print head 3' is upstream of first printhead 3, the media 32 can be transported by way of endless belt 9*a* to second inkjet printhead 3' which can be adapted to apply ink onto at least an area of the printed image corresponding to the detected streak to repair the streak in the printed image; or more particularly, can be adapted to only apply ink onto the area of the printed image that corresponds to the detected streak. In the event that the redundant printhead 3' is downstream of first printhead 3 (and upstream of image capture device 7), the media with the printed image thereon is conveyed past redundant printhead 3' (which is not activated at this point) and to image capture device 7 to inspect the printed image for a defect. If a defect is detected, the media is cycled back to the redundant printhead 3' for image repair as discussed above. Within the context of the present invention, you can also provide for an embodiment where first printhead 3, camera 7 and redundant printhead 3' can be placed in a serial manner in accordance with direction of travel 720. In this embodiment, after printing by printhead 3, camera 7 can be used to inspect the printed image as described above, and if a defect is detected, the redundant printhead 3' located downstream from camera 7, can be used to repair the image as also described above. As in the embodiment of FIG. 3, in the embodiment of FIG. 4, media waste would be reduced or eliminated. If as a result of this inspection, a streak is not detected, media 32 does not have to be conveyed back to redundant printhead 3, in the case where redundant printhead 3' is upstream of printhead 3; or can be conveyed past redundant inkjet printhead 3' which is not activated in the case where the redundant printhead 3' is downstream of printhead 3.

If a dark streak is detected, the compensational mode can include diverting the printed media with the dark stream to a waste bin, not shown. With the defective nozzle that made the dark defect deactivated, the document is reprinted. By deactivating the defective nozzle, the dark streak is now replaced during a first printing pass with a white defect. With a white streak present after printing a first pass of the document, the redundant printhead can be used to correct for the white defect as described above.

In a printing system having a redundant printhead, another embodiment of a preemptive correction for subsequent documents can include switching the roles of the primary and redundant printheads so that the printhead that initially served as the redundant printhead assumes primary responsibility for printing subsequent documents. In a feature of the embodiment of FIG. 4 where redundant inkjet printhead 3' is utilized, the first and second inkjet printheads (3, 3') can be interchangeably used. For example, after a first image is printed using one of the inkjet printheads 3, 3' as noted above, a second image can be printed using the second one of the inkjet printheads 3, 3' on a second media. The second printed image can then be conveyed to image capture device 7 where it is inspected to detect a presence of at least a streak in the printed second image caused by a defect in the second one of the inkjet printheads 3, 3'. If a streak is detected, the second media with the printed second image thereon is transported to the first one of the inkjet printheads 3, 3' through the use of conveying device 34, and ink from the first one of inkjet printheads 3, 3' is applied at least onto an area of the printed second image corresponding to the detected streak to repair the streak in the printed second image, or the first one of the inkjet printheads 3, 3' can be adapted to only apply ink onto the area of the printed image that corresponds to the detected streak. By interchanging which printhead 3, 3' is used as the primary printhead for printing a document, this embodiment reduces the risk that ink will dry in the nozzles of one of the printheads to cause a printhead failure. It is noted that in the embodiment of FIG. 4 the remaining elements or modules which are identified with the same reference numerals as the elements or modules in FIG. 3 are similar to and operate in a similar manner to the corresponding elements or modules shown in FIG. 3.

In a further embodiment of the present invention, in addition to inspecting the printed image for the presence of a streak, the printed image can be further inspected relative to print density. More particularly, in this further embodiment, the printed image can have a target print density and during the inspection step the printed image is inspected to detect a print density of the printed image. In some embodiments the print density is measured with a spectrophotometer. In other embodiments a camera or image capturing sensor, either a linear array sensor or a 2D area array sensor is used to determine the print density. Additionally, the inline camera can also be capable of detecting the print density. For example, each camera pixel can detect intensity (i.e. optical density) and this property permits its use to detect print density. In some embodiments, the printing system includes a print density standard which can be positioned in the field of view of the spectrophotometer, camera or image capturing sensor to enable the print density measurements of the sensor to be calibrated. Also, a feedback mechanism can be used to compare the imaged density to a look up table of density to know when to stop laying down more ink once the desired density has been reached.

With reference to FIG. 3 as an example, if the result of this inspection is that the print density is below the target print density, media 32 with the printed image thereon is transported back to inkjet printhead 3 by conveying device 34. In this embodiment, inkjet printhead 3 is used at least one more time to print a second image on top of the first image, such that at least a portion of the second image is the same as the first image to thereby raise the print density.

A still further embodiment of the present invention relates to the printing of images at high optical density to provide for improved photographic prints or provide for images that are to be used in advertising and/or packaging which frequently includes highly contrasting colors of high density to capture a viewer's attention. Other examples for high optical density images could be to provide for changes in optical density within a page for the purpose of drawing attention to the content region, for example, for advertisement; or for the printing of brochures that use special paper or other special print media where some pages or portions of pages can be printed at very high optical density, while maintaining normal optical density on the rest of the page(s). In the situation where the image is to be printed at high optical density, in which a normal single pass printing ink laydown would incur coalescence, the content can be printed in parts, in which each pass receives a low enough ink laydown so that coalescence would not occur.

In this embodiment of the present invention, an image capture device 7 such as a camera or scanner would scan the printed content, and optionally use alignment patterns printed in the margins around the printed content, so that any positional shift in media position, between passes, can be detected. U.S. Pat. No. 8,104,861 discloses an example of an alignment target. This shift is then fed back to the inkjet printhead (for example inkjet printhead 3 in FIG. 3) so that subsequent content laydown can be properly aligned to the previous laydown. In between each pass, the media can be fixed or dried using dryer 905 or dryer 905 in combination with optional additional dryers 980, 982 and 984 shown in FIG. 3, so that the media surface is able to receive further ink laydown without coalescence. Multi-pass printing with video feedback will allow higher optical density laydown without loss of ink laydown artifacts so that the printed image can approach the optical density of photographic prints.

An embodiment of this invention will be described with reference to FIG. 3. In FIG. 3, inkjet printhead 3 as previously described is used to print a first image pattern having a low optical density onto media 32. The media 32 is then transported by way of conveyor device 34, to dryer 905 or dryer 905 can be positioned over the media to at least partially dry the first printed image pattern on the media. Additionally, selected ones of further dryers 980, 982 and 984 can be used depending on the amount of drying desired and/or the location of the media along the print path where dryer is desired. The media while being electrostatically held on belt 9*a* is then conveyed back to inkjet printhead 3 which is then used at least one more time to print a second image pattern having a low optical density on top of the first image pattern. At least a portion of the second image pattern is the same as the first image pattern and the media with the first image pattern and the second image pattern printed thereon is then dried. The printing apparatus of the present invention can optionally include a humidity sensor 998 to help determine the state of the media with respect to humidity.

In this embodiment of the invention, in order to provide for a more precise positioning of the media with respect to the inkjet printhead, the first image pattern can be scanned using image capture device 7 and information from this scan can be used to determine if the media has shifted while being conveyed or during printing. If it is determined that the media has shifted, the scan information can be used to adjust a position of one of the media or the inkjet printhead relative to the other of the media or the inkjet printhead, to align the inkjet printhead with the first image pattern prior to the printing of the second image pattern. This adjustment can be done using a motorized movement device as described above with reference to U.S. Pat. Nos. 4,435,718 and 6,164,643. The printhead can be an extra row of printheads or one single printhead on a bar and it can move cross track to the region of interest on an as-needed basis.

As a further option, the printed first image pattern can be scanned and the information from the scan can be used to determine if the media has shifted and caused a distortion of the first image pattern. If the media has shifted to cause a distortion of the first image pattern, the scan information can be used to alter the second image pattern to account for at least one of the shifts in the media or the distortion of the printed first image pattern.

In a still further feature of the invention, the imaging and conveying section 18, 18' may include an optional air jet array 990 as shown in FIGS. 3 and 4 having a curvature that matches the curvature of roller 9*b* or 9*c* and air outlets that face belt 9*a*. While air jet array 990 is shown in FIGS. 3 and 4 as partially surrounding roller 9*b*, it is noted that air jet array 990 can be located to partially surround roller 9*c*, or more than one air jet array to partially surround both rollers 9*b* and 9*c* can be used depending on the amount of drying and/or the drying control desired. Air jet array 990 can be used to direct air toward belt 9*a* to help maintain the media 32 on roller 9*b* or 9*c* as the media is transported around roller 9*b* or 9*c*, while also providing additional drying options for drying the ink on media 32 as the media 32 is transported past, for example, roller 9*b*. An example of an air jetting arrangement with respect to media and inkjet printing is illustrated in U.S. Pat. No. 7,966,743. Air jet array 990 can also be used in combination with or as an alternate to dryers 905, 980, 982 and 984 during the high optical density printing method of the present invention.

Additionally, for electrostatic-based hold down of media on a belt in which the media is cycled around many times, it is necessary to consider how to hold down the media when it travels from a flat (or near flat) portion of the transport surface to a curved region, as the media is made to turn over. Media comes in a variety of stiffness and thickness, often measured by its modulus. When a media is made to change directions, for example to cycle it around, the media is usually made to wrap itself around the shape of an underlying roller, and the leading edge of the media can come off the transport surface increasingly easier as the diameter of the roller decreases. For a given electrostatic charging condition, the key factors to consider are the paper modulus and the roller diameter. The easiest region for paper to separate from the roller is at its leading edge. Hence extra care needs to be taken to ensure that the electrostatic charging at the leading edge is high. This can be carried out with a dedicated charging station prior to turning the paper to ensure a maximum electrostatic attractive force as shown in FIGS. 3 and 4 with respect to charger 907. Additional features such as high pressure air jet impinging on the media upper surface in the large diameter roller region can also be used as described above with regard to air jet array 990. Finally, a good estimate of the roller diameter for this application is to make sure that the length of the paper in the transport direction is less than ½ the circumference of the roller. This way the entire paper can stay on the curved belt surface during the paper turn, thus ensuring the maximum attractive force that can be placed on the paper. Additionally, a force can be provided on endless belt 9*a* to help tension the belt. In the example of FIGS. 3 and 4 it is shown that the belt 9*a* at roller 914 and 916 is slightly extended to help tension the belt.

Additionally, for all of the disclosed embodiments of the invention, it is possible to mix in printing passes with drying passes (so that the bottom of the paper does not get wet). Humidity sensor 998 can be used, in line, to determine whether a drying pass is needed, and printing can be permitted only if the humidity sensor provides an approved or acceptable humidity level to allow printing.

Some embodiments of the printing system or apparatus of the present invention can include a database or lookup table stored in processor-accessible memory, which contains information related to paper characteristics. While printing, the user would select using the user interface (for example, user interface system 730 of FIG. 3) the media type being used. Based on the known characteristics of the selected media, the controller (for example, controller 702) of the printing system can determine a number of passes to be carried out to reach an intended print density level. The image capture device 7 can be used to confirm that the number of passes determined from the lookup table do yield the desired print density, allowing the number of passes to be increased or decreased from the number determined from the paper characteristic information found in the lookup table. Also based on the known paper characteristics, the printer, can as a document is making its multiple passes, add additional non-print passes so that the paper or print media can be cycled through a dryer an additional time between successive printing passes. In some embodiments, the printer controller in response to information obtained from a database or lookup table can also adjust one or more of the following: the transport speed of the print media, the dryer power level, the dryer air flow rate, the charging level to be applied to the print media or the transport belt to secure the print media to the transport belt, the airflow rate to be supplied to the air jet array 990 that helps maintain the media on the belt 9*a* at rollers 9*b* or 9*c* or various other printer control parameters to enhance the print quality. In some embodiments, the printing system can add to or update the information in the database or lookup table to include information related to a new paper or print media, or to better account for the characteristics of a particular media, or to better account for the user's preferences related to print quality.

The invention has been described in detail with particular reference to certain preferred embodiments thereof, but it will be understood that variations and modifications can be effected within the spirit and scope of the invention.

What is claimed is:

1. A method of printing comprising the steps of:

transporting media in an initial print pass to an inkjet printhead;

using the inkjet printhead to print an image on the media by applying ink from nozzles on the inkjet printhead onto said media;

inspecting the printed image on the media to detect a presence of at least a streak in said printed image caused by at least one defective nozzle in said inkjet printhead;

transporting the media with the printed image thereon in an additional print pass back to said inkjet printhead if a streak is detected on said printed image;

adjusting a cross track position of one of the media or the inkjet printhead relative to the other of the media or the inkjet printhead to position a non-defective nozzle of the inkjet printhead over the detected streak; and applying ink from the non-defective nozzle to an area of the printed image corresponding to the detected streak to repair the streak in said printed image.

2. A method according to claim 1, further comprising:

processing the printed image if a streak is detected to determine a location of the detected streak relative to an edge of the printed image on the media, such that said adjusting step adjusts the cross track position of the one of the media or the inkjet printhead relative to the other of the media or the inkjet printhead in accordance with the determined location of the detected streak.

3. A method according to claim 1, wherein said inspecting step comprises scanning the printed image on the media to detect the presence of the streak.

4. A method according to claim 1, wherein the media with the printed image thereon is not transported back to said inkjet printhead for said additional print pass if a streak is not detected on the printed image.

5. A method according to claim 4, wherein the media is transported past said inkjet printhead in the same direction during the initial print pass and the additional print pass.

6. A method according to claim 5, wherein for subsequent media, the cross-track position of one of the media or the inkjet printhead relative to the other of the media or the inkjet printhead is adjusted such that the defective nozzle is aligned with a non-print region of the image.

7. A method according to claim 1, wherein said step of transporting the media with the printed image thereon in the additional print pass back to said inkjet printhead if a streak is detected on said printed image comprises transporting the media with the printed image thereon in a cyclical path to a position upstream of the inkjet printhead with respect to a direction of travel of said media.

8. A method according to claim 1, wherein the printed image has a target print density, and wherein the inspecting step further comprises detecting a print density of the printed image, such that the method further comprises:

transporting the media with the printed image thereon back to said inkjet printhead if the detected print density is below the target print density; and using said inkjet printhead at least one more time to print a second image on top of the first image, wherein at least a portion of the second image is the same as the first image to thereby raise the print density.

9. A method according to claim 1, wherein said media is transported on an endless belt.

10. A method according to claim 9, further comprising charging the endless belt to hold the media on the belt during transport through electrostatic adhesion.

11. A method according to claim 1, wherein said ink is a aqueous based ink.

12. A printing apparatus comprising:

an inkjet printhead adapted to print an image on media by applying ink from nozzles on the inkjet printhead onto the media;

an image capture device adapted to inspect the printed image on the media to detect a presence of at least a streak in said printed image caused by at least one defective nozzle in said inkjet printhead; and an adjustment device adapted to adjust a cross track position of one of the media or the inkjet printhead relative to another of the media or the inkjet printhead if a streak is detected on said printed image by said image capture device to position a non-defective nozzle of said inkjet printhead over the detected streak, so that ink from the non-defective nozzle can be applied to an area of the printed image corresponding to the detected streak to repair the detected streak in said printed image.

13. A printing apparatus according to claim 12, further comprising:

a media conveying device adapted to convey the media along a media transport path pass said inkjet printhead during a first print pass to print the image on the media, and recirculate the printed image having a streak detected thereon back to the inkjet printhead for a second print pass for the repair of the detected streak.

14. A printing apparatus according to claim 12, wherein the image capture device is a scanner adapted to scan the printed image on the media.

15. A printing apparatus according to claim 14, wherein the scanner is located along the media transport path downstream of the inkjet printhead with respect to a direction of travel of said media, and the conveying device is adapted to return the media back to the inkjet printhead for the second print pass or eject the media with the printed image thereon.

16. A printing apparatus according to claim 13, wherein the conveying device comprises an endless belt to which the media is secured for transport.

17. A printing apparatus according to claim 16, wherein the media is secured to the endless belt by electrostatic forces.

18. A printing apparatus according to claim 12, wherein said ink is an aqueous based ink.

19. A printing apparatus according to claim 17, further comprising a discharging unit which can selectively decrease the electrostatic forces holding the media to the endless belt.

20. A printing apparatus according to claim 16, further comprising an air jet array directed at the endless belt where the endless belt wraps partially around a roller that guides the endless belt.

21. A printing apparatus according to claim 17, wherein the electrostatic forces securing the media to the endless belt are higher at the lead edge of the media than in other portions of the media.

22. A printing apparatus according to claim 12, wherein the media includes a boundary which surrounds a printing region, such that printing only occurs in the printing regions.

* * * * *